US005548688A

United States Patent [19]

Wiklof et al.

[11] Patent Number: 5,548,688

[45] Date of Patent: Aug. 20, 1996

[54] METHOD OF DATA HANDLING AND ACTIVATING THERMAL PRINT ELEMENTS IN A THERMAL PRINTHEAD

[75] Inventors: Christopher A. Wiklof, Everett; Edward M. Millet, Seattle, both of Wash.

[73] Assignee: Intermec Corporation, Everett, Wash.

[21] Appl. No.: 172,859

[22] Filed: Dec. 23, 1993

[51] Int. Cl.[6] ..... B41J 2/36

[52] U.S. Cl. ..... 395/108; 346/76 PH; 347/195; 347/211; 347/180

[58] Field of Search ..... 395/101, 108, 395/114, 375; 346/76 PH, 76 R

[56] References Cited

U.S. PATENT DOCUMENTS

| | | | |
|---|---|---|---|
| 3,909,626 | 9/1975 | Balasubromaniah et al. | 235/156 |
| 3,975,707 | 8/1976 | Ito et al. | 346/76 R |
| 4,464,669 | 8/1984 | Sekiya et al. | 346/76 PH |
| 4,567,488 | 1/1986 | Moriguchi et al. | 346/76 PH |
| 4,590,488 | 5/1986 | Sullivan | 346/76 PH |
| 4,789,870 | 12/1988 | Lacord et al. | 346/1.1 |
| 4,870,428 | 9/1989 | Kuwabara et al. | 346/76 PH |
| 4,928,117 | 5/1990 | Takeuchi | 346/76 PH |
| 4,937,590 | 5/1990 | Robillard et al. | 346/76 PH |
| 5,085,529 | 2/1992 | McGourty et al. | 400/120 |
| 5,153,605 | 9/1992 | Ohara et al. | 346/76 PH |
| 5,349,348 | 9/1994 | Anderson et al. | 341/51 |
| 5,357,271 | 10/1994 | Wiklof et al. | 346/76 PH |
| 5,365,257 | 11/1994 | Minowa et al. | 346/76 PH |
| 5,366,307 | 11/1994 | McGourty et al. | 400/708 |

FOREIGN PATENT DOCUMENTS

| | | | |
|---|---|---|---|
| 57178776 | 11/1982 | European Pat. Off. | B41J 3/20 |
| 60064571 | 4/1985 | European Pat. Off. | H04N 1/21 |
| 63251253 | 10/1988 | European Pat. Off. | B41J 3/20 |
| 0329369 | 2/1989 | European Pat. Off. | B41J 3/20 |
| 2022732 | 1/1990 | European Pat. Off. | G06F 5/00 |
| 0045825 | 1/1991 | European Pat. Off. | B41J 2/36 |
| 0439162 | 7/1991 | European Pat. Off. | B41J 2/355 |
| 63-173660A | 7/1988 | Japan | B41J 3/20 |
| 2228450 | 8/1990 | United Kingdom | B41J 2/36 |
| WO93/14935 | 8/1993 | WIPO | B41J 2/355 |

*Primary Examiner*—Mark R. Powell
*Assistant Examiner*—Gabriel I. Garcia
*Attorney, Agent, or Firm*—Seed and Berry LLP

[57] ABSTRACT

A method of supplying an energization signal to a selected element in an array of print elements. Printing activity of the selected element and neighboring elements is determined, compressed and stored to memory. Based on the stored compressed printing activity data, an energization schedule for the selected element is determined using a look-up table technique. The data in the look-up table may also be compressed reducing the memory required by the energization data. Further reductions in memory are achieved by grouping portions of the printing activity data to identify common energization schedules for differing printing activities. The printing activity data may relate to temporal distributions and/or spatial distributions of printing activity of elements in the array. The method may be applied to linear or two-dimensional arrays of print elements.

32 Claims, 7 Drawing Sheets

$P_1$ to $P_a$ = S (State of current element)

$P_{a+1}$ to $P_N$ = $\overline{S}$ (Opposite of state of selected element during current SLT)

| SLT | a | b | c | d | e | f | g | h | i | j | k | l | m | n | o | p |
|---|---|---|---|---|---|---|---|---|---|---|---|---|---|---|---|---|
| STATE | 1 | 1 | 1 | 1 | 0 | 0 | 0 | 0 | 1 | 1 | 1 | 0 | 0 | 1 | 0 | 0 |
| | | $C_1$ | | $C_2$ | $F_1$ | | | | $F_2$ | | | | | | | |

*Current element is* $C_1$ $C_1 = 1,\ S_1 = 1\ \ (F_1)_1 = 00010,\ (F_2)_1 = 100$

*Current element is* $C_2$ $C_2 = 1,\ S_2 = 0\ \ (F_1)_2 = 00100,\ (F_2)_2 = 011$

| $F_1$ | $S_1$ | $F_2$ | $F_3$ | $S_2$ |
|---|---|---|---|---|
| 011 | 1 | 00110 | 101 | 1 |

| 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|
| 0 | 0 | 0 | 1 | 1 | 1 | 1 | 1 | 1 | 0 | 0 | 0 | 0 | 0 | 1 | 1 | 1 | 1 | 1 | 1 | 1 | 1 | 1 |

| 23 | 24 | 25 | 26 | 27 | 28 | 29 | 30 | 31 |
|---|---|---|---|---|---|---|---|---|
| 1 | 1 | 1 | 1 | 1 | 1 | 1 | 1 | 1 |

METHOD OF DATA HANDLING AND ACTIVATING THERMAL PRINT ELEMENTS IN A THERMAL PRINTHEAD

DESCRIPTION

1. Technical Field

The present invention relates to the field of thermal printheads driven by signals produced in response to monitored and anticipated device parameters and heating schedules.

2. Background of the Invention

Typical thermal printheads are comprised of linear arrays of small thermal print elements, each producing heat in response to an input signal. Individual print elements are often lengthwise segments of a resistive strip of thermal material to which input electrical currents are applied. As current passes through the segments associated with a print element, resistive heating occurs locally, producing the desired heat. Selected print elements heat a thermally sensitive paper or other thermally responsive print medium, causing it to darken locally and thereby produce printing.

In the printer, the print medium moves in a transverse direction with a stepped movement past the array of print elements. The print medium is in thermal contact with the print elements as it is stepped past the array. During each step, desired print elements are selectively heated and the portions of the print medium in thermal contact with the heated print elements are darkened from the heat transferred to them from the heated print elements. Each darkened portion is referred to as a pixel.

The time during which the array of print elements is aligned with a given row of print medium portions to print an associated line of pixels, before being stepped to the next row of print medium portions, is called a scan line time or SLT. The SLT may further be broken down timewise into segments, allowing portions of the SLT to be treated separately. This is useful in cases such as when a heating schedule for a line of pixels is changed during an SLT. The SLT is inversely proportional to the printer speed for a given pixel line width.

In typical thermal printheads, a print command signal is input to each print element selected to print during a particular SLT. The signal is designed to raise the temperature of the print element to a prescribed temperature and to maintain the temperature level for a prescribed time. In a simplistic example, the print element is energized at a constant level during the entire SLT if printing is desired and is not energized at all if no printing is desired.

In more sophisticated printheads, the print command signal is a logical AND combination of a data signal and a strobe signal. Because this signal from the logical AND of the data signal and the strobe signal controls whether or not the print elements are heated at any particular time, it will be referred to herein as the energization signal. In previous printheads, the strobe signal has been used to compensate for the long-term heat build-up in the printhead while the data signal has controlled the selection or non-selection of elements.

The strobe signal is adapted, for example, when the printer first begins operation and the printhead temperature is below its nominal operating temperature, to allow a longer heating period to allow extra heating of the print elements. Such compensation allows the print elements to reach the desired temperature for printing during the SLT. If no compensation were incorporated, lines of pixels printed during warm-up would be lighter than desired due to insufficient heat being transferred to the print medium during the SLT. After the printhead has warmed up, the heating period can be reduced for nominal operation because of the effect of the residual heat each print element will retain as a result of its prior heatings.

Even after the printhead has warmed up, the strobe signal may be used to compensate for long-term temperature variations in the printhead as a whole which cause the printhead to be below or above its desired nominal operating temperature, Where, for instance, an element or group of print elements is subjected to a heavy printing schedule, the accumulated residual heat can raise the operating temperature of the printhead or a group of print elements above the nominal operating temperature. This can cause overdarkening of the corresponding pixels that are printed for that line. In actuality, the overheating causes the pixel size to be larger than desired, thus giving the appearance of an overly dark pixel. This results because the energization signal is generated with the assumption that the print element to which it is applied is at the nominal operating temperature. If the print element is hotter, the resultant pixel that is printed is too dark. Similarly, where the printing schedule is very light, such as where very little is being printed on the print medium, the printhead may cool to almost the ambient temperature, causing any pixels that are printed to be lighter than desired, much as described above for the warm-up period.

The strobe signal is used advantageously to compensate for such varying operating conditions by monitoring the printhead operation and adjusting the strobe signal to accommodate.

Conditions other than the recent printing schedule of print elements also affect printing performance and the strobe signal is also used to compensate for these. For example, print speed, media type, ambient temperature, heat sink temperature, print element resistance, print darkness selections, and power supply voltage may cause variations in the printhead temperature, desired maximum temperature and other printing parameters.

Typically, the strobe signal is primarily useful in compensating for various printhead parameter variations only on a global basis. That is, the strobe signal is used to compensate over the entire print element array, but compensating for individual print element variations using the strobe signal is extremely difficult. For example, in an array of 256 print elements, transmission of 256 individual strobe signals to the closely spaced elements raises difficulties due to cross-talk between lines. The cross-talk problem worsens at higher frequencies. Thus, as printhead development permits faster print speeds, strobe signal cross-talk makes multiple strobe signals less desirable. Further, production of 256 adaptive strobe signals increases the complexity of the array-driving apparatus considerably.

Adaptive energization of heating elements in response to the conditions affecting each element individually has been attempted previously and one such successful attempt is described in U.S. patent application Ser. No. 07/830,310, filed Jan. 31, 1992. By monitoring and storing into memory data corresponding to the printing history of a selected print element corresponding to a target pixel and the current printing activity of adjacent print elements, compensation for short-term and/or local conditions can be effected. The stored printing activity data is used to evaluate short term or localized effects on the selected print element. Based on various local and/or temporally close print element activity, the data signal is adapted to improve printing performance of the selected print element. This is accomplished by supplying the energization signal only during certain, predetermined segments of the SLT.

As a simple example of a beneficial adjustment in the energization signal based on recent heating history of the print elements, consider the case where, during several preceding SLTs a selected print element was "ON," during the current SLT the selected print element is "ON," and during the future SLTs the print element will be "OFF," with "ON" and "OFF" referring to whether the print element is sufficiently heated to print a pixel or not. This situation corresponds to the printing of an edge of a bar code. Printing performance may be improved by stopping the energization signal to the selected print element prior to the end of the current SLT, such that the element will cool and printing of the bar will stop more precisely at the end of the current SLT.

Printing performance may be improved still further by providing the energization signal intermittently during early segments of the SLT such that printing occurs during the current SLT, but doing so in a manner to hold the selected print element at a temperature just slightly above the temperature at which it will print a pixel, allowing printing to stop more abruptly when the energization signal is removed and provide a sharper edge to the printed bar.

While the above described technique provides an improvement over previous methods, it can require storage and manipulation of a significant amount of printing activity data if a meaningful heating history is to be stored and utilized. This can limit the processing and printing speed of the thermal printhead. Where only a limited amount of memory space is allocated to the storage of such data, it is not possible to store and utilize the large quantity of data needed, thus requiring use of a less than desirable heating history.

The difficulty in storing and manipulating data becomes even more problematic where a wide range of possible energization signals is desired. A distinct energization signal may be desirable for each variation in factors such as desired print state, printing schedule of the selected print element, and printing schedule of adjacent print elements. Storing and manipulating the data associated with the possible energization signals then becomes increasingly burdensome as more information regarding printing schedules, and other factors is utilized.

In the past, there has been no feasible approach to handling the increased quantity of data required to compensate for meaningful history and local conditions beyond temporally close SLTs.

Further, because of this limited information handling ability, there has been no way to permit consideration of the activity of print elements beyond those immediately adjacent to the selected print element. While the more spatially distant print elements may not be particularly relevant in terms of thermal effects on the selected print element, their printing history can provide valuable information. For example, in a bar code printer the activity of print elements is often correlated to whether a picket fence or drag line printing of a bar code is being performed. This information can be used to enable improved compensation for effects such as line discontinuities.

SUMMARY OF THE INVENTION

The current invention provides an improved method of adaptively driving a thermal printhead in response to monitored historical data and anticipated heating schedules. The inventive method reduces the memory required for a given amount of historical and anticipated printing activity information required to be stored and manipulated in producing an adaptive driving signal for an array of print elements.

The method employs a data compression technique in combination with past and future printing activity of print elements to select desired energization signals. For convenience, data relating to the combination of past and future printing activity with respect to an element will be referred to as "printing activity data." The amount of printing activity data, and thus the requisite memory capacity, necessary to provide a meaningful basis for determining the driving signal is reduced as a consequence of the data compression. For a given amount of available memory, the method increases the effective historical and/or spatial basis upon which such a determination can be made.

This increase in the nominal duration of printing history accommodated for a given amount of available memory is made possible by the recognition that certain of the printing activity data are more relevant than others in analyzing the performance of and obtaining a desired response from the print element. In the present invention, a lossy data compression approach permits the memory to be utilized to store only the most relevant activity data. Less relevant data is not stored in the memory and thus a portion of the memory is freed for additional printing activity data. The result is a more effective and efficient utilization of the available memory in the printer.

Based on the stored compressed printing activity data, an energization schedule for a selected SLT is produced for the selected print element. That is, a schedule is produced dictating whether the energization signal will be in an "ON" state or an "OFF" state for each segment of the SLT. In the preferred embodiment, a look-up table technique is used to produce the energization schedule in response to various printing activity data. In the look-up table technique, data relating to the desired schedule for energizing the selected print element during the selected SLT is retrieved from a RAM-based memory containing previously stored data. Data is stored in a RAM-based memory. The data stored in RAM consists of sequences of bits with each bit of data in the RAM representing the energization or lack of energization of the selected print element for a particular segment of the SLT with 32 bits of data defining the energization schedule of the print element for the entire SLT. For convenience, the data representing the energization schedule for the selected print element during a predetermined SLT will be referred to as energization schedule data. Each set of 32 bits in each memory location corresponds to a specific pattern of the printing activity data, giving each set a unique identity. The specific pattern can thus be used as an address to identify its associated energization schedule data. Thus, for each particular printing schedule, the energization schedule data for a particular element is "looked up" in the RAM-based memory based upon the address defined by the printing activity data. The energization schedule data is combined with the strobe signal in a logical AND combination to drive the selected print element, allowing compensation based upon the particular printing schedule of the selected print element and upon system wide considerations, such as measured temperature.

Because the memory is RAM based, its contents may be varied based on various device parameters such as type of print medium used or the selected printing speed of the printer. The energization schedule data in the RAM may be derived by the printer microprocessor by performing calculations using the value of printing speed of the printer in an established algorithm. Alternately, the energization schedule data may be loaded from a ROM data stored in a printer ROM, upon start-up or in response to a user's input. Thus, the inventive method can be adapted for use with varying print parameters and conditions.

The printing activity data used to identify the location of the energization schedule data in the RAM is not limited to the printing schedule of the selected print element. Alternately, the printing activity data may include the activity of an entire array of print elements. In such a case, data in a multidimensional matrix describing the printing activity of the entire array can be compressed.

The inventive method is not limited to manipulating printing activity data. Energization schedule data in the look-up table RAM may also be compressed to reduce the memory storage requirements associated with the printhead for adaptation based upon a given amount of printing history. In fact, compression of the look-up table data in combination with compression of printing activity data can yield even further efficiency.

In the preferred embodiment of the inventive method, a modified run length encoding compression technique is employed. Other data compression techniques are also within the scope of the invention.

DETAILED DESCRIPTION OF THE INVENTION

Figure 1:
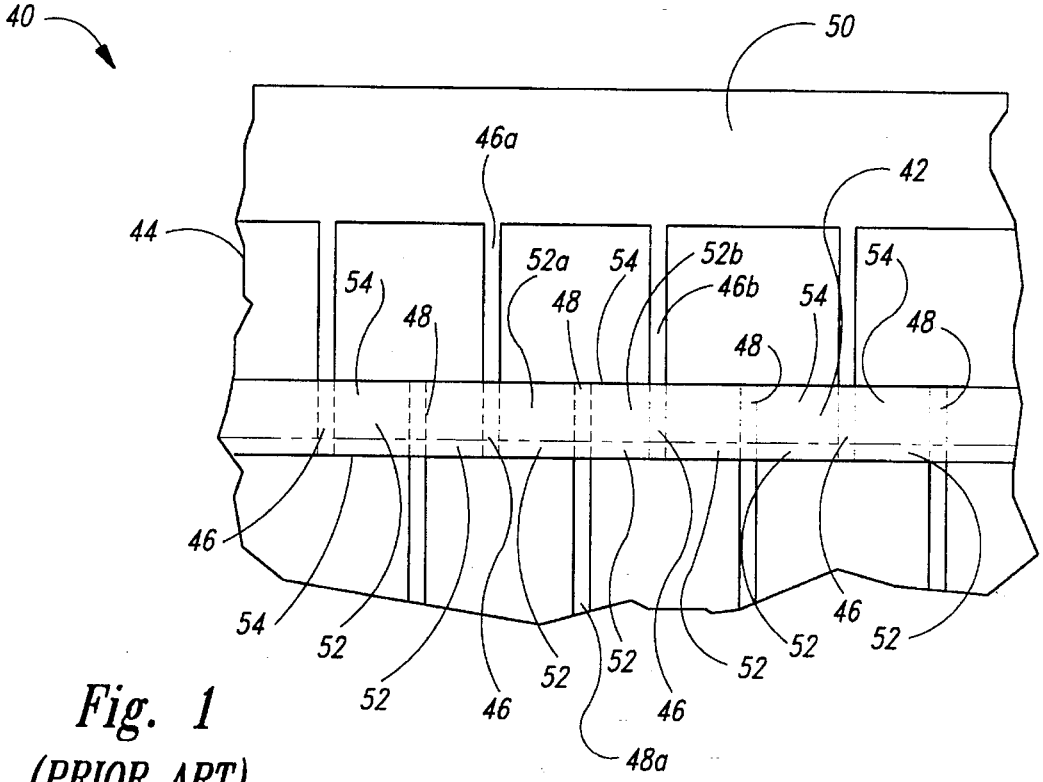
Fig. 1 (PRIOR ART)
FIG. 1 is a top plan view of a portion of a conventional thermal printhead used with the present invention.

The method according to the present invention is implemented in a printer having a conventional thermal printhead 40 such as shown in FIG. 1. The thermal printhead 40 has a substrate 44 with a print bead 42 formed by a continuous linear raised deposition of resistive material that protrudes outward beyond the general level of the adjacent upper surface of the printhead. The resistive material heats when it receives electrical current. The print bead 42 is deposited over and comes into electrical contact with a plurality of first conductive leads 46 and a plurality of second conductive leads 48. The first and second conductive leads 46 and 48 are uniformly and alternately positioned under the print bead 42, and have a width of substantially less than the center-to-center spacing between adjacent leads. An equal length segment 52 of the print bead 42 is thereby provided between each pair of adjacent leads.

The first conductive leads 46 serve as anode leads, and are held at a predetermined positive supply voltage through their connection to a conductor 50, upon which supply voltage is imposed. The second conductive leads 48 serve as cathode leads, and are selectively grounded, as described below, to allow conduction through selected ones of the segments 52 of the print bead 42. If a particular second conductive lead 48, such as the lead marked with reference numeral 48*a* in FIG. 1 is grounded, a conductive path is completed between the grounded second conductive lead 48*a* and the two adjacent first conductive leads 46, marked with reference numerals 46*a* and 46*b*, permitting the passage of electric current between these first conductive leads and through the two segments 52 of the print bead 42 marked with reference numerals 52*a* and 52*b*. The resulting conducted current causes the segments 52*a* and 52*b* of print bead 42 surrounding the grounded second conductive lead 48*a* to heat, thereby creating a small rectangular resistive print element 54 with a length equaling the center-to-center separation between first conductive leads 46.

When the print bead 42 is in thermal contact with a thermally sensitive print medium, such as a thermal paper, a black "dot" or pixel will be printed by the heated print element 54. If, on the other hand, the second conductive lead 48*a* is not grounded, the print element 54 will not heat and a black dot will not be printed. Each pair of print bead segments 52 about one of the second conductive beads 48 forms one resistive print element 54 which is selectively heatable to print a pixel by grounding of the associated second conductive lead 48.

Figure 2:
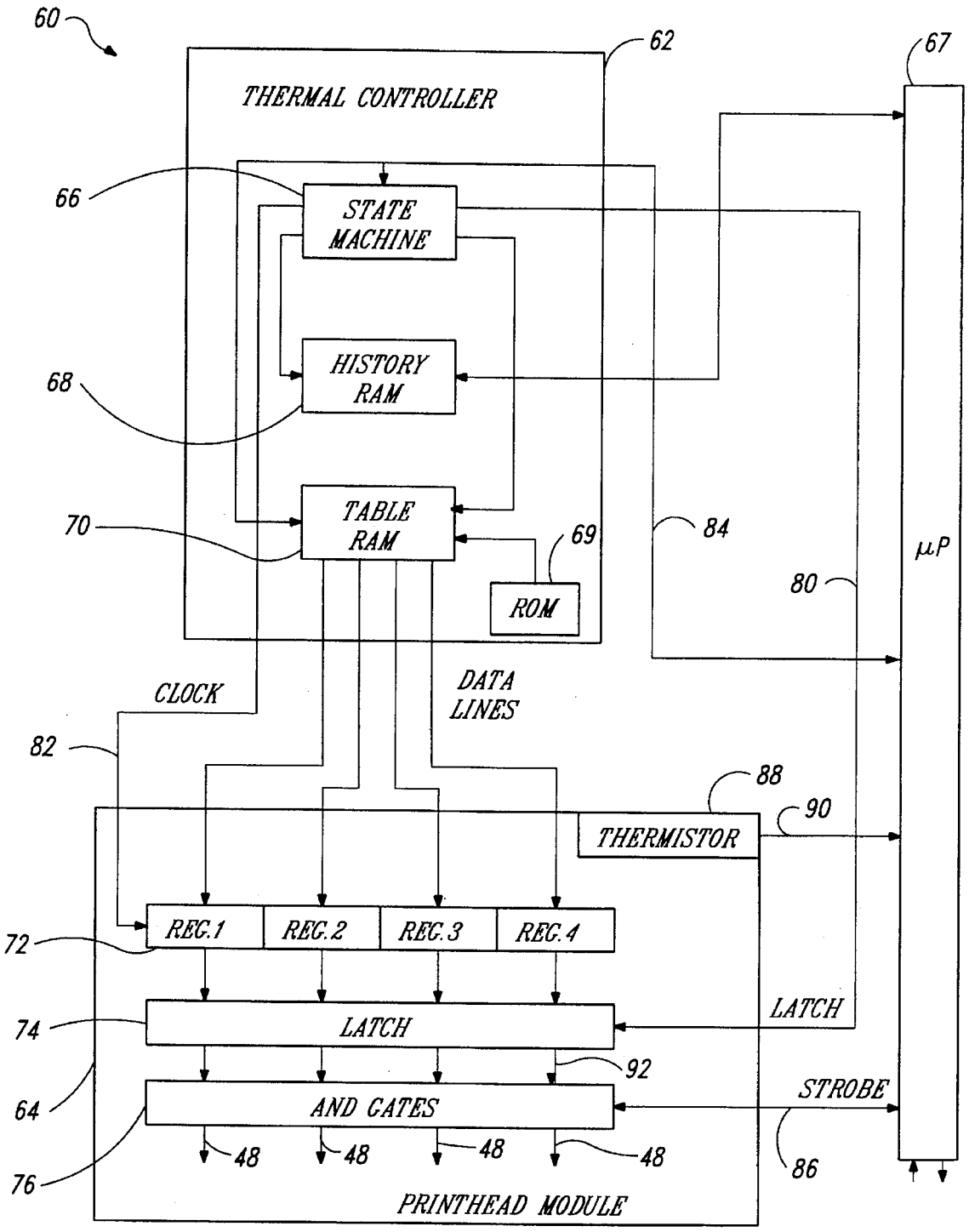
FIG. 2 is a schematic diagram of a section of a controlling apparatus implementing the preferred embodiment of the invention.

A printhead controller 60 used to perform the inventive method is shown in FIG. 2. The printhead controller 60 contains a thermal controller 62 and a printhead module 64. The thermal controller 62 includes a state machine 66, a history RAM 68 and a table RAM 70. The printhead driver module 64 includes four registers 72, a latch 74 and AND gates 76, using one AND gate for each print element 54 in the thermal printhead 40.

The history RAM 68 and the table RAM 70 of the thermal controller 62 are connected to receive, store and transfer data under control of the state machine 66. The table RAM 70 is connected to the registers 72 by output lines 78 which enable transfer of data from the table RAM 70 to the registers 72. A latch line 80 connects the state machine 66 to the latch 74. A clock line 82 connects the state machine 66 to the registers 72. External control lines 84 are connected to the state machine 66 and table RAM 70, permitting data transfer and selection of operating parameters from an external source (not shown) under control of the microprocessor 67, such as a user interface. A strobe line 86 providing a strobe signal from the microprocessor 67 is connected to the AND gates 76. The outputs of the AND gates 76 are connected to the second conductor leads 48 of the printhead 40 to control the individual print elements 54 of the printhead. As will be explained below, the AND gates 76 combine the strobe signal and the energization schedule data received from the table RAM 70 through the registers 72 to produce current to drive the print elements 54. A thermistor 88 is incorporated in the printhead driver module 64 with a thermistor line 90 providing coupling to the thermistor 88.

Figure 3:
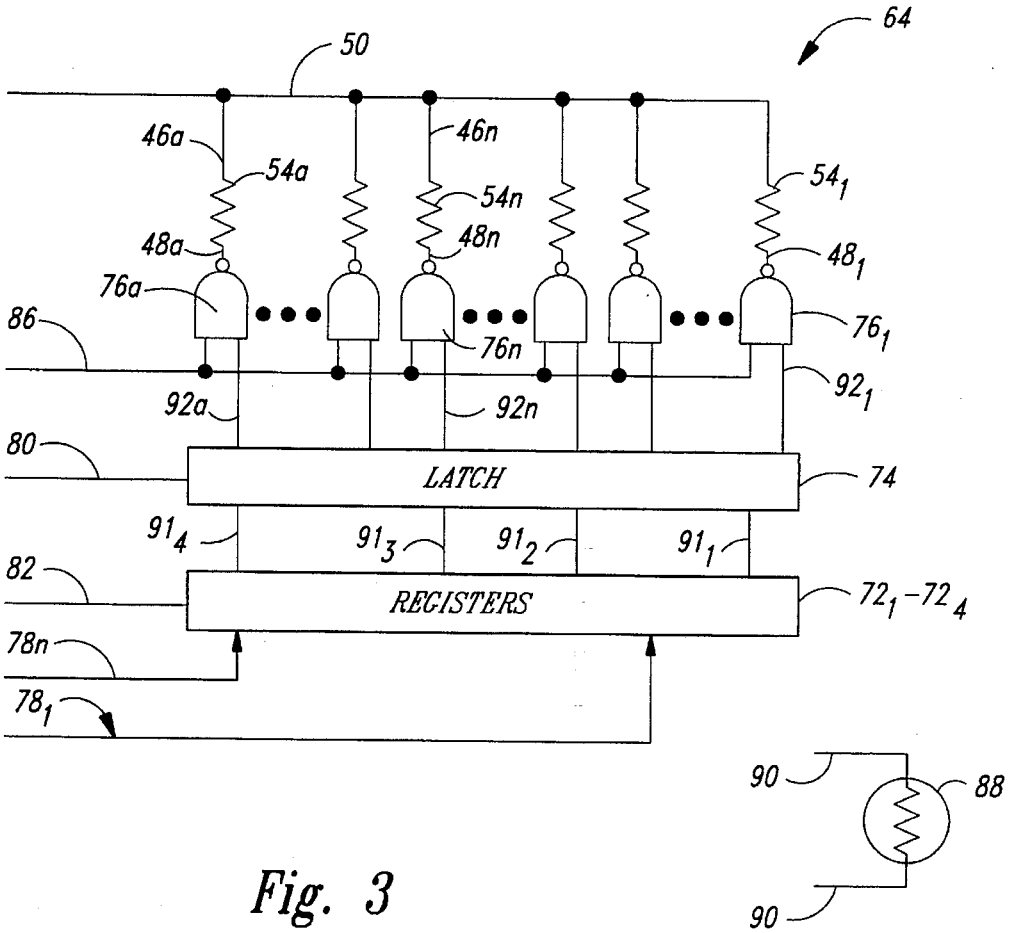
FIG. 3 is a schematic diagram of a printhead driver module of the controlling apparatus of FIG. 2.

FIG. 3 is a schematic drawing of the printhead driver module 64 of FIG. 2. The register 72 is comprised of registers $\mathbf{72}_1$ to $\mathbf{72}_4$ which are connected by lines $\mathbf{91}_1$ to $\mathbf{91}_4$, respectively, to the individual latches that comprise the latch 74. The latch 74 is connected to the individual AND gates $\mathbf{76}_1$ to $\mathbf{76}_a$ that comprise the AND gates 76 by latch driver lines $\mathbf{92}_1$ to $\mathbf{92}_a$, respectively, where "a" represents the number of print elements 54 comprising the printhead 40. The remaining input of each of the AND gates 76 is connected to the strobe line 86. Each of the AND gates $\mathbf{76}_1$ to $\mathbf{76}_a$ has its output connected to one of the individual resistive print elements $\mathbf{54}_1$ to $\mathbf{54}_a$, respectively, that comprise the print elements 54 via a corresponding one of the individual second conductive leads $\mathbf{48}_1$ to $\mathbf{48}_n$ that comprise the second conductive leads 48. As described above, each of the resistive print elements 54 is also connected to positive supply voltage conductor 50 via a corresponding one of the individual first conductive leads $\mathbf{46}_1$ to $\mathbf{46}_a$ that comprise the first conductive leads 46.

Each print element 54 of the thermal printhead 40 is controlled by an energization signal generated by supplying a strobe signal and a data signal in the form of energization schedule, to the input of each of the AND gates 76 over the strobe line 86 and over the latch driver lines $\mathbf{92}_1$ to $\mathbf{92}_a$. The strobe signal is used to compensate for such variables as ambient temperature, heat sink temperature, user-selected darkness, power supply voltage, and printhead average print element resistance. The strobe signal is also used to reduce the thermal stress on each print element 54 by modulating the energization signals applied to the print elements during warm-up of the printhead 40. The strobe signal is produced in the microprocessor 67. As is conventional, the strobe signal may vary considerably in response to changes which occur over relatively long periods of time (typically in excess of 100 SLTs). Energization schedule data are provided, as described below, primarily to accommodate shorter term variations affecting the energization of the print elements 54. Selection and generation of the energization schedule data are described below. The AND gates 76 perform a logical AND function, combining the strobe signal and the energization schedule data to provide an energization signal for the print elements 54.

Figure 4A:
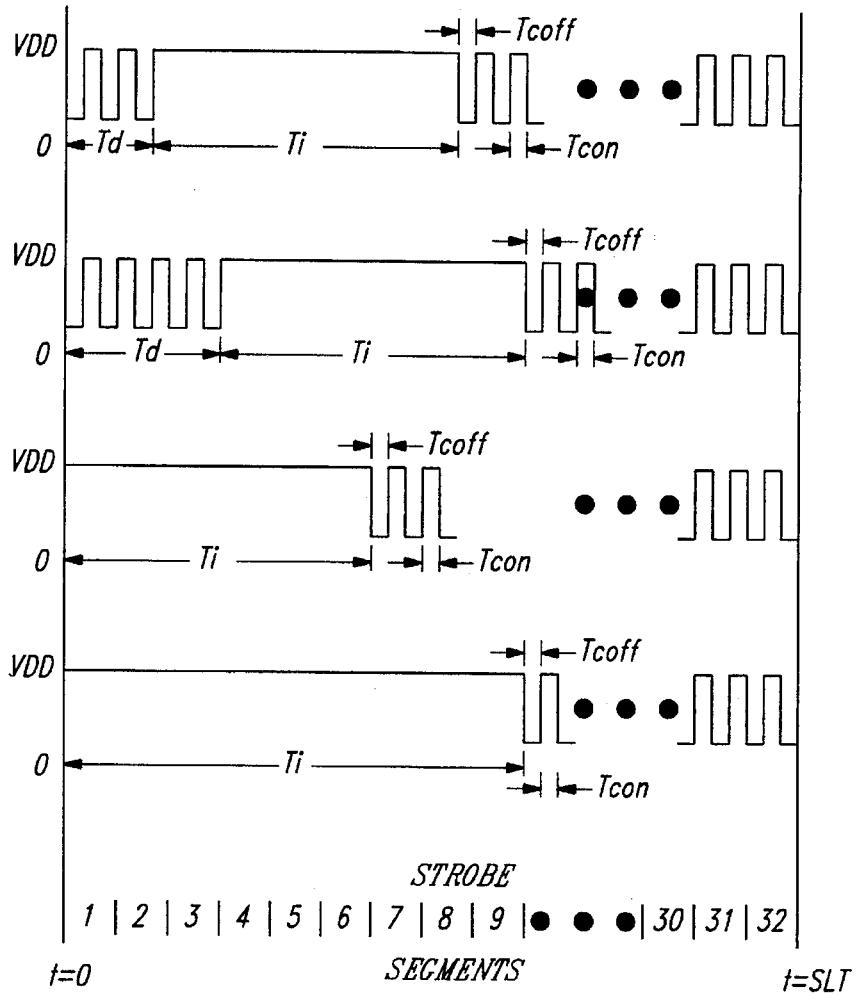
FIG. 4*a* is a diagram of example strobe signals used in practicing the method of the invention.

FIG. 4*a* depicts one SLT and shows four different strobe signals, each representing one of many possible strobe signals available for use during a given SLT. In the preferred embodiment, the SLT is broken into 32 segments. The strobe signal may change states multiple times within a segment.

Figure 4B:
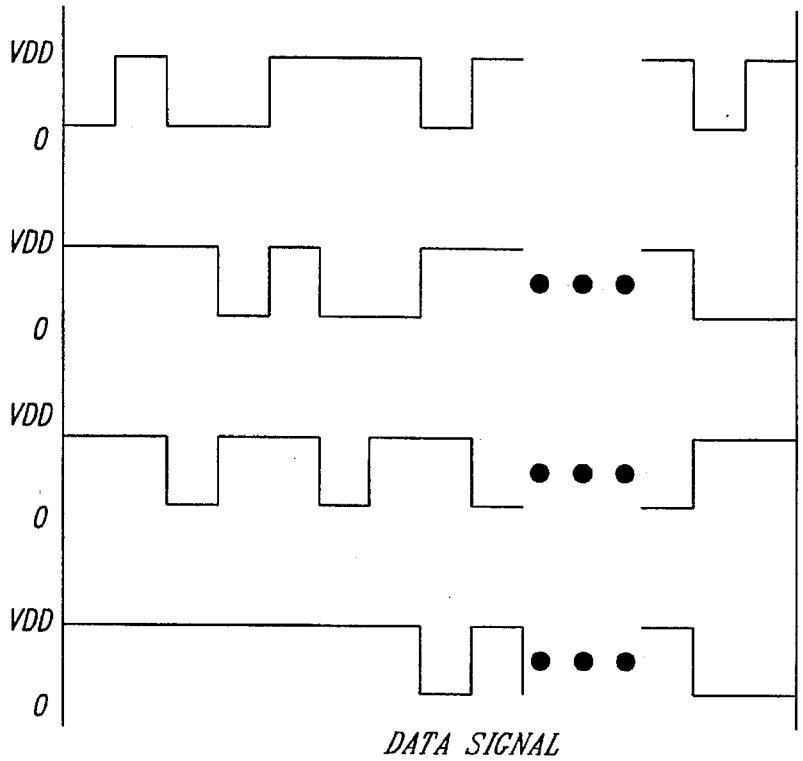
FIG. 4*b* is a diagram of example data signals used in practicing the method of the invention.

FIG. 4*b* shows four different possible 32-bit sequences that comprise four different sequences of energization schedule data which may occur during one SLT, with one bit of each data sequence corresponding to each segment of the SLT. Thus, in the 32-segment SLT shown in FIG. 4, $32\times23^2$ different data sequence combinations are possible for use as the energization schedule data. If each possible data sequence combination comprising the energization schedule data is stored in memory, $32\times2^{32}$ memory locations having 32 bits each will be necessary. As will be discussed hereinafter, the present invention provides a reduction in the memory required.

In the preferred embodiment, the 32-bit data sequences corresponding to the energization schedule data are stored in the table RAM 70. In practice, it is preferred to subdivide the data sequences into subsequences of lesser length to permit the data sequences to be stored in readily available, inexpensive 8-bit memory devices. For example, the 32-bit data sequence of the preferred embodiment is broken into four data subsequences of 8 bits each with each 8-bit data subsequence representing a portion of the energization schedule.

The segments are numbered 1 to 32, with the number of each segment being its segment count. The binary representation of the segment count is then 00000 to 11111. The two most significant binary bits of the segment count are then used as part of the memory address to indicate the particular 8-bit data subsequence. For the first eight segments of a particular SLT, the first 8-bit data subsequence stored is used. The memory address of this first 8-bit data subsequence would be 00XX . . . X, where XX . . . X is the memory address derived as described hereinafter and 00 are the first two bits of the numbers 00000 to 00111 representing the SLT segment counts from 0 to 7. The data sequences are predetermined in view of the printhead parameters, empirical practice and calculations and are loaded into the table RAM 70 from a device ROM 69 in the state machine 66 upon system startup or may be loaded in response to a user's input. Data transferred from the table RAM 70 to the registers 72 and data transfers within the printhead controller 60 are controlled by the state machine 66. The state machine 66 is a conventional programmable logic array. The state machine 66 is programmed in a conventional manner to control transfers of data response to the system clock from the clock line 82 based upon the segment count and in response to comments from the microprocessor 67. The operation of the state machine 66 is described below. While the preferred embodiment divides the SLT into 32 segments, it will be understood by one skilled in the art that other divisions of the SLT are within the scope of the invention. It will also be understood that while compensation for variations in printing speed is made by adjusting the duration of the scan line time. In the present invention a variation of the scan line time can be accomplished either by varying the number of segments in the SLT or by varying the duration of individual segments.

Figure 4C:
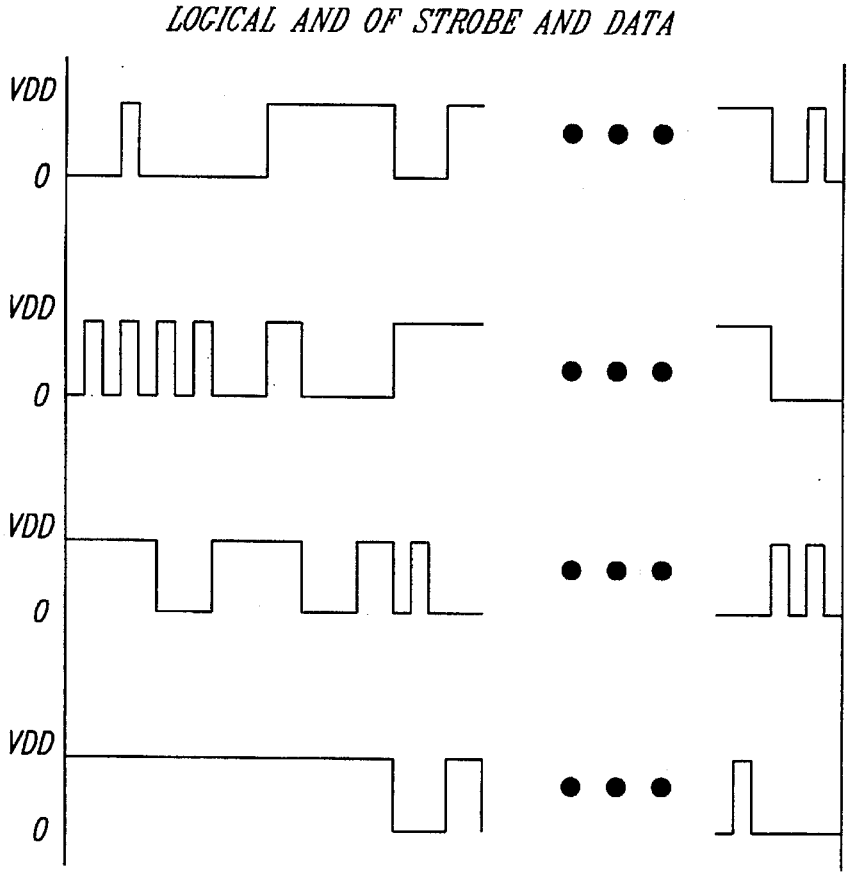
FIG. 4*c* is the logical AND of the strobe and data signals of FIGS. 4*a* and 4*b*.

FIG. 4*c* shows the logical AND of the four example strobe signals and the four example energization schedule data signals of FIGS. 4*a* and 4*b*. As can be seen from FIG. 4*c*, the energization signal actually received by, for example, the print element $\mathbf{54}_n$ is thus regulated by both the signal produced in response to the energization schedule data signal on latch drive line $\mathbf{92}_n$ and the strobe signal on strobe line 86. The signals representing the energization schedule data from the table RAM 70 reach the AND gates 76 through the registers 72 and the latch 74. As explained earlier, 8-bit data subsequences of the energization schedule data are retrieved from the table RAM 70 based partially upon the two most significant bits of the segment count, with the remainder of the address determined as described hereinafter. The 8-bit data subsequences are transferred to corresponding ones of the four registers 72 and are then clocked into the latch 74 one bit at a time, such that the latch 74 contains one bit of energization schedule data for each of its associated AND gates 76 during a selected segment of the SLT. During the selected segment, the data in the latch 74 drives one input of each of the associated AND gates 76. Simultaneously, the strobe signal is applied to the remaining input of each of the AND gates 76. In response, the AND gates 76 provide print command signals to the print elements 54.

Figure 5A:
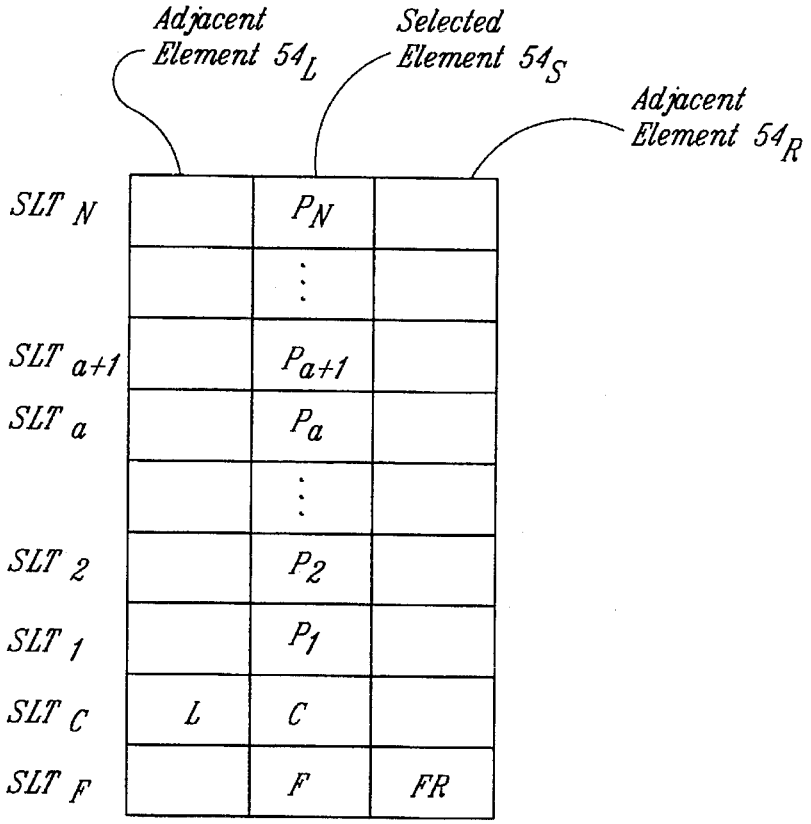
FIG. 5*a* is diagrammatic representation of printing activity data corresponding to a print element and two adjacent print elements used with the invention.

The determination of the appropriate energization schedule data will now be described. FIG. 5*a* is a diagrammatic representation of a printing schedule of a selected one of the print elements 54 represented by reference numeral $\mathbf{54}_S$, during a current scan line time $SLT_C$ (the SLT for which the energization schedule data will be determined), a future scan line time $SLT_F$ (the SLT immediately following $SLT_C$) and N past scan line times $SLT_1$ to $SLT_N$ (the N SLTs preceding $SLT_c$). Additionally, the representation shows a portion of the printing schedule of the two immediately adjacent print elements $\mathbf{52}_L$ and $\mathbf{54}_{FR}$ during the same periods of time. For purposes of this description, only printing activity in one adjacent print element $\mathbf{54}_L$ during the current scan line time $SLT_C$, and printing activity for the remaining adjacent print element $\mathbf{54}_{FR}$ during the future scan line time $SLT_F$ are shown in the table of FIG. 5*a*. Consideration of other print elements and operations during differing SLTs is also within the scope of the invention.

It will be appreciated that the data contained in the locations in table of FIG. 5*a* described above represent the printing or non-printing of the selected print element $\mathbf{54}_S$ and adjacent print element print elements $\mathbf{54}_L$ and $\mathbf{54}_{FR}$ corresponding to a given SLT. This data has been defined earlier as the printing activity data. This is distinguished from the sequences of energization schedule data representing energization during segments of the SLT as described with respect to FIGS. 4*a*–4*c*.

The entries in the table of FIG. 5*a* are shown as a two-dimensional matrix of printing activity data indexed with respect to time in one direction and lateral position in the second direction. It can be seen that the inventive method may be applied generally to matrices of dimension higher than 2 and matrices having differently designated indices. As an example of the latter, if a two-dimensional array of elements is used for area printing, the table of FIG. 5*a* may be a two-dimensional matrix representing current activity of elements located throughout the two-dimensional array. If this example were extended to consider historical and future activity of the two-dimensional array, each SLT considered would produces a corresponding two-dimensional array of printing activity data. This would result in a three-dimensional data matrix with the third index being time.

Most, or all, of the printing activity data in the table of FIG. 5*a* must be stored in a memory location associated with the selected print element $\mathbf{54}_S$ corresponding to the current $SLT_C$. For convenience, the selected print element during the current $SLT_C$ will be referred to as the current element $\mathbf{54}_C$. A representation of the bits occupied in memory by the printing activity data is shown in the lower portion of FIG. 5*b*. Each of the characters F, FR, L, C, and $P_1$ to $P_N$ is a logic level 1 or a logic level 0 representing the printing or nonprinting, respectively, of the selected print element $\mathbf{54}_S$ or adjacent print elements $\mathbf{54}_L$ and $\mathbf{54}_{FR}$ during the SLT indicated in the table of FIG. 5*a*. It can be seen that N+4 memory bits are required to store the printing activity data presented in the table, in the absence of any memory saving process. In actual practice, the bit designated by the character "L" may be derived easily from memory associated with an adjacent bit, reducing the required number of bits in memory by one bit. Thus, for N+3 bits of memory, a bit history of N SLTs along with the current bit, one future bit and one printing activity data bit relating to each adjacent element can be stored according to conventional methods.

The storing of data into memory locations associated with the appropriate SLT is controlled by the state machine 66. The appropriate referencing of each bit of print element data is performed by the aging of printing activity data at the completion of each SLT. For the printing activity data, this means that at the conclusion of a given scan line time each bit of printing activity data is shifted in the history RAM 68 to a memory location corresponding to its position relative to the upcoming SLT. For example, the printing activity data for the current scan line time (i.e., the scan line time just completed) is transferred to a memory location corresponding to the immediately preceding scan line time and printing activity data for next scan line time (i.e., the scan line time about to begin) is transferred to the memory location corresponding to the then current scan time line. This also requires that data for the most distant future scan line time being treated is loaded from the microprocessor 69 into the history RAM 68. For example, if printing activity data for five future scan line times is used in the method according to the invention, after aging printing activity data for the fifth future scan line time (i.e., moving it to a memory location corresponding to the fourth future scan line time) printing activity data is loaded by the microprocessor 69 into the memory location corresponding to the fifth future scan line time. Similarly, the state machine 66 ages the data signal discussed above for increments of the segment count so that data for each segment is transferred from the table RAM 70 to the appropriate shift register 72 in the appropriate sequence.

The preferred embodiment of inventive method increases the effective relevant history of the current element $\mathbf{54}_{SC}$ for a given amount of memory by compressing the printing activity data relating to the current element before storing it in memory. In the preferred embodiment, the printing activity data is compressed using a modified run length compression technique.

Figure 5B:
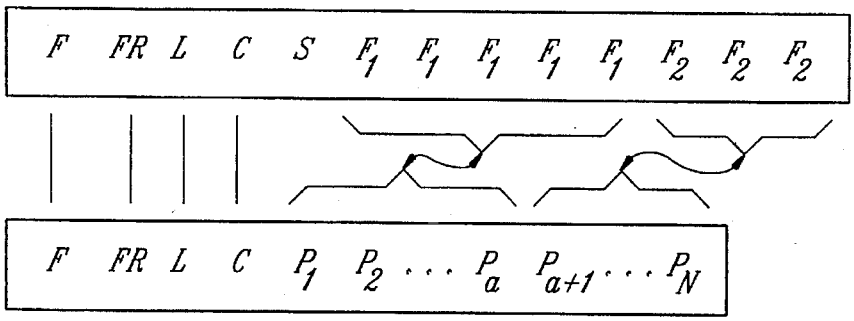
FIG. 5*b* is a diagrammatic representation of correspondence between the data of FIG. 5*a* and compressed data.
Figures 6A, 6B, 6C:
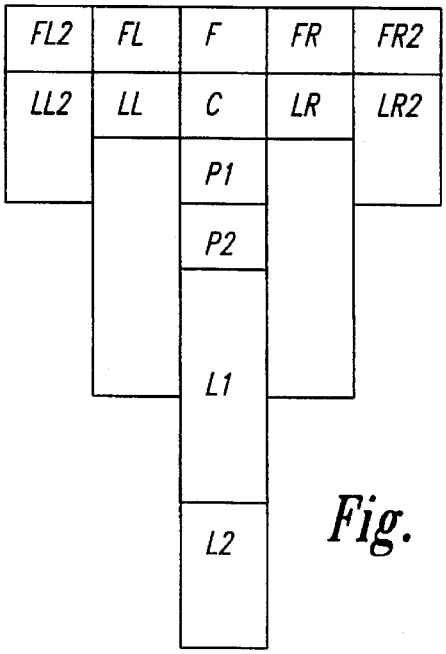
FIG. 6*a* is a diagrammatic representation of a example sequence and data fields associated with selected print elements used with the invention.
FIG. 6*b* is a diagrammatic representation of printing activity data corresponding to a print element and adjacent print elements used with the invention.
FIG. 6*c* is a diagrammatic representation of printing activity data corresponding to a print element, two adjacent print elements and two print elements neighboring the two adjacent print elements.

Two examples of the method described with respect to FIGS. 5*a* and 5*b* will now be presented with reference to FIGS. 6*a* and 6*b*. FIG. 6*a* shows a sequence of printing activity data corresponding to the selected print element $\mathbf{54}_S$ where a logic level 1 state represents printing during a given SLT and a logic level 0 state represents no printing during the SLT. The SLTs are indicated by the letters a through p in FIG. 6*a* and will be used below as subscripts to indicate particular SLTs.

A sequence with the selected print element in a logic level 1 state during the current SLT, $SLT_b$ begins with a current element $\mathbf{54}_{C1}$ as indicated by $C_1$ in the table. The state of the current element during the future SLT, $SLT_a$ is also a logic level 1. The state of the current element during the immediately preceding two SLTs, i.e., $SLT_c$ and $SLT_d$ was also a logic level 1. During the third through seventh preceding SLTs, i.e., $SLT_e$–$SLT_h$ the state of the current element was a logic level 0 and during the eighth through tenth preceding SLTs, i.e., $SLT_i$–$SLT_k$, the state of the current element was a logic level 1.

In a conventional method, the printing activity data presented in FIG. 6*a* would correspond to a memory address. In each address, corresponding energization schedule data would reside. The energization schedule data would be selected based upon the activity of the current element.

A meaningful indication of variations in the needed energization of the current element can be developed instead, based upon (a) the duration of time during which the current element (and possibly the adjacent elements $54_L$ and $54_{FR}$) has been in its current state (i.e., its state during the current SLT, $SLT_C$) and (b) the length of time during which the element (or elements) was in its respective opposite states (i.e., the opposite logic state to the current state). This permits the application of a lossy compression scheme to be applied to the printing activity data, increasing for a given amount of memory space the effective length of printing activity upon which the selection of an energization schedule may be based.

Using the sequence described with regard to the current element $C_1$ of FIG. 6*a*, an example of the technique is illustrative. Neglecting for purposes of the immediate discussion the bits stored in the locations designated by FR and L, the data in the memory shown in the lower portion of FIG. 5*b*, each representing the logic level of the selected print during a given SLT, would be, F=1, for the future SLT, $SLT_a$, $C_1$=1, for the current SLT, $SLT_b$; and $P_1$=1, $P_2$=1, $P_3$=0, $P_4$=0, $P_5$=0, $P_6$=0, $P_7$=1, $P_8$=1, $P_9$=1, for the immediately preceding nine SLTs, $SLT_c$–$SLT_j$.

If instead of the above data format, the state of the current element, the state of the selected print element $54_s$ during the immediately preceding SLT, i.e., $SLT_c$, and the number of SLTs during which the selected print element was in that state, and the number of SLTs during which the selected print element was in the opposite state are stored in memory, using five bits for the number of SLTs in the first preceding state and three bits for the number of SLTs in the second preceding state, the printing activity data represented in the lower portion of FIG. 5*b* will map into memory as shown in the upper portion of FIG. 5*b*. The first four bits F, FR, L, and C map directly from the previously described memory structure to the modified memory of the lower portion of FIG. 5*b*. For the sequence beginning at $C_1$ described above for FIGS. 6*a* and 6*b*, the state bit (i.e., the bit representing the state of the current print element), S, is 1. The number of SLTs during which the selected element was in the state S is two ($SLT_c$ and $SLT_d$). This is represented in the five bit data field $(F_1)_1$ as 00010. The number of SLTs during which the selected element was in the opposite state $\overline{S}$ is four ($SLT_e$–$SLT_h$). This is represented in the three bit data field $(F_2)_1$ as 100.

The same technique is applied for each SLT. A second example is shown in FIGS. 6*a* and 6*b* for a current SLT, $SLT_d$ as indicated at $C_2$. The printing activity data relating to the SLT, $SLT_d$ is given in the corresponding line of FIG. 6*b*.

Using the lossy modified run length compression scheme described above printing activity data relating to fewer previous SLTs is retained than in an approach using non-compressed printing activity data. Such occasions may occur, for example, when pixels are turned ON and OFF in rapid succession. The inventors have determined, however, that in such instances, the nature of the image being printed reduces the importance of a lengthy history of printing activity to optimally maintain print quality as compared to cases where the pixel state is kept the same for longer periods of time. The inventive method thus retains the more relevant historical information while discarding less relevant information to free memory space.

The recognition of the relative relevance of these particular aspects of printing activity data is particularly advantageous in bar code printing where bar widths need to be controlled accurately and where heat accumulation in the print element is strongly dependent on the widths of the two immediately preceding lines (e.g., space/bar) of the bar code symbol but much less dependent on the widths of lines of the bar code symbols prior to the two succeeding elements. The inventive method is particularly advantageous in enabling a lengthy history of the print element to be treated, therein permitting the selection of a word length for F ($L_1$) sufficient to fully encode bar codes which might be expected to occur.

While the preceding examples demonstrate the application of the inventive method to a relatively small number of historical states, it can be seen that, using the 5-bit and 3-bit data fields described above, the compressed printing activity data may describe the history up to 38 previous SLTs. This occurs when $(F_1)_N$= 11111= 31 and $(F_2)_N$= 111=7. This compares to 9 SLTs stored in memory in the prior technique using the same memory space.

The printing activity data presented in FIGS. 5*a* and 5*b* are representative of data which are commonly used in short term or local compensation. Other combinations of printing activity data may be used for varying compensation techniques.

The compression technique described with respect to FIGS. 5*a* and 5*b* and FIGS. 6*a* and 6*b* may be generalized to include printing activity data for more than three present elements. In one alternative embodiment, data relating to five elements are utilized as represented by FIG. 6*c*. While this embodiment uses printing activity data for five elements, as described below, the technique may be generalized to utilize data from any number of print elements.

As shown in FIG. 6*c*, the printing state of the selected print element $54_S$ is represented during the current SLT by C. As before, the selected print element $4_S$ during the current SLT is the current element. Its printing state during the immediately succeeding SLT is represented by F. P1 and P2 represent the previous and second previous states of the selected print element. L1 is a binary representation of the number of SLTs during which the current print element was in the second preceding state and L2 is the number of SLTs during which the current print element was in the state opposite the second preceding state.

The left adjacent print element's future state is designated FL and the left adjacent print element's left neighbor's future state is designated FL2. The future states of print elements to the right are numbered FR and FR2 according to the same convention. The number of SLTs during which the elements corresponding to data FL2, FL, FR, and FR2 are in those states, respectively, are represented by the data sequences LL2, LL, LR, and LR2.

In this embodiment, the sequences L1, L2, LL2, LL, LR and LR2 are 5 bits, 3 bits, 2 bits, 3 bits, 3 bits and 2 bits, respectively. Energization schedule data corresponding to each possible combination of these data can be developed, permitting compensation for printing activity relating to up to 7 SLTs, 3 SLTs and 32 SLTs for the adjacent elements, neighbors to the adjacent elements and the selected element, respectively, using 26 bits of memory storage.

The compression of printing activity data may be generalized to any number of neighboring print elements in a similar fashion. Compression of data relating to a greater number of print elements may allow compensation for the type of image being printed or may allow adjustment of the energization signal to compensate for specific image types, such as picket fence bar codes. For example, if compression permits sufficient data to be utilized, it may be possible to determine if a solid line or picket fence bar code is being printed. The energization schedule data of the individual print elements could then be adjusted accordingly, for example, to anticipate rapid changes in printing states or prolonged constant printing states.

Figures 7, 8A, 8B:
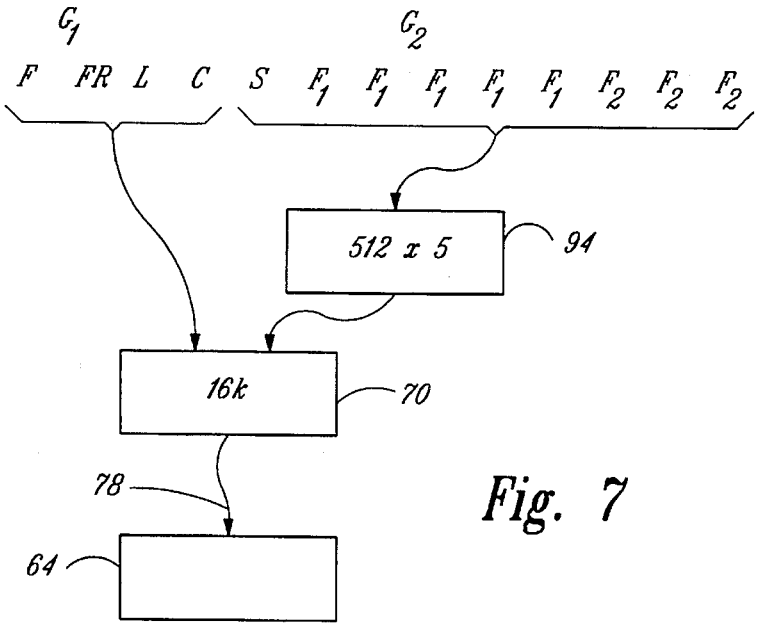
FIG. 7 is a diagrammatic representation of a method of storing data using grouping according to the method of the invention.
FIG. 8*a* is a diagrammatic representation of an energization schedule for a selected print element according to the method of the invention.
FIG. 8*b* is a diagrammatic representation of the correspondence between the data of FIG. 8*a* and compressed data.

Further compression of data may be realized by compressing printing activity data using a grouping technique as shown diagrammatically in FIG. 7. Using the same data structure described with reference to FIGS. 5*a* and 5*b* and FIGS. 6*a* and 6*b*, printing activity data pertaining to the current print element can be broken down into two groupings. In the preferred embodiment, the first group consists of the current and future printing states of the current print element and the selected states of the adjacent print elements together forming a sequence G1. The second group consists of the printing activity data representing the state of the selected print element during the immediately preceding SLT and the 5-bit and 3-bit data fields described above, forming a 9-bit data sequence G2. The 9-bit data sequence G2 is used as an address in a grouping memory 94 with $2^9$ or 512 memory locations, in the same manner as addresses are used in the description of the look-up table technique above. A 5-bit sequence corresponding to 5 bits of a 9-bit memory address is stored in each of the memory locations. The remaining 4 bits of the memory address are provided by the 4-bit sequence G1 corresponding to the current, future and adjacent printing states. The 9-bit memory address is an address in the table RAM 70 in which the previously described data sequences are stored. This address is used in conjunction with the two most significant bits to retrieve data comprising sequences of energization schedule data for input to the registers as described previously.

The reduction in data addresses realized by the grouping method relies on the similarity in effect of distinct printing histories. If, for example, the selected print element $\mathbf{54}_S$ has been in an "ON" state (a logic level 1) for several preceding SLTs, it may be assumed that a solid black bar is being printed. The desired energization schedule in such an instance may not vary significantly for differing lengths of the preceding "OFF" state. Consequently, a common energization schedule is sometimes appropriate for several similar printing activities. By grouping the printing activity data into 32 different groups and designating an appropriate energization schedule for each group, it is possible to reduce the 9-bit data sequence G2 employed as an address in the grouping memory 94 to a 5-bit sequence comprising a portion of the 9-bit address sequence for the table RAM 70.

As can be seen by the example described above, the inventive method allows compensation based on the current and future printing states of a selected print element, the current and future printing states of adjacent print elements and data relating to up to 38 previous SLTs of the selected print element while requiring only a 512×5 RAM and a 512×32-bit RAM. Each of the above described steps of compression and grouping advantageously improves the data handling and storage requirement of a printhead 40 using data compensation for short-term printing activity. In combination, the two techniques provide even further improvement. The improved data handling and storage capability of the inventive method allow significantly longer printing histories to be utilized in implementing compensations for a given amount of memory.

Further efficiency in the use of data in a thermal printhead 40 can be achieved by compressing energization schedule data in the table RAM 70. As, shown in FIG. 8*a*, a 32-bit energization schedule can be presented as five binary numbers representing three data fields, F1, F2, and F3, and two state bits, S1, S2. From the three data fields and two state bits, a 32-segment energization schedule can be produced for a given SLT.

The first data field F1 presents the number of SLT segments during which the energization signal is to be in a logic level 0. The first state bit S1 presents the state of the energization signal during the time defined by the second data field F2. The third data field F3 presents the number of SLT segments during which the energization signal is in the opposite state from S1. The second state bit 52 presents the state of the energization signal during the remainder of the SLT segments not previously defined.

In this embodiment, the first data field F1 has three bits, the second data field F2 has five bits, and the third data field F3 has three bits. Thus, the 32-segment SLT can be defined by a total of 13 bits.

An example according to this method is shown in FIG. 8*b*, with the energization schedule of FIG. 8*b* used to produce a corresponding compressed data sequence as shown in the lower portion of the table of FIG. 8*a*. As defined by the data in field F1, the energization schedule is in a logic level 0 for the first three segments, 0–2. The energization schedule is in a logic level 1 as prescribed by the state bit S1 during the subsequent 6 segments as defined by the second data field F2. The signal is then in the opposite state, that is, a logic level 0, during the subsequent 5 segments as defined by the third data field F3. During the remainder of these segments, the energization signal is in a logic level 1, as prescribed by the second state bit S2.

As previously described, for a 32-segment SLT and a total of 9 bits of printing activity data, a table RAM of 512×32 is required. If the data in the table is compressed according to the method illustrated in FIG. 8*a*, the required table RAM size is 512×13.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method of producing a desired response in a selected print element during a present activation time interval in a thermal printhead having an array of print elements in response to image data, wherein each bit of image data represents the printing or non-printing of a pixel of an image during the present activation time interval or an activation time interval other than the present activation time interval, comprising:

establishing a desired print state for the selected print element during the present activation time interval in response to the image data;

determining a printing schedule of the selected print element in response to the image data;

in response to the image data, generating printing activity data for the selected print element, each bit of the printing activity data corresponding to a bit of the image data, the printing activity data corresponding to the present activation time interval and at least one other activation time interval;

while retaining the original image data, compressing the printing activity data to form a compressed printing activity data sequence;

storing the compressed printing activity data sequence at a memory location associated with the selected print element in a first memory;

determining an energization schedule for the present activation time interval in response to the stored compressed printing activity data sequence and the desired print state of the selected print element;

producing an energization signal representative of the energization schedule; and applying the energization signal to the selected print element to print an image according to the image data without loss of resolution in the image data.

2. The method of claim 1, further comprising the step of deriving a memory address from the compressed printing activity data, the memory address representing a location in a second memory associated with the selected print element and containing stored energization schedule data, the stored energization schedule data representing the energization schedule.

3. The method of claim 2 wherein the step of determining an energization schedule comprises retrieving the stored energization schedule data from the memory location represented by the memory address.

4. The method of claim 3 wherein the step of compressing the printing activity data comprises applying a run length compression technique to the printing activity data to produce the compressed printing activity data.

5. The method of claim 4, further comprising grouping a plurality of distinct compressed printing activity data sequences such that the memory address derived from each one of the plurality of distinct printing activity data sequences is identical.

6. The method of claim 1 wherein the step of determining the printing schedule includes determining the printing schedule with printing activity data for the selected print element corresponding to at least one interval following the present interval.

7. The method of claim 6, further comprising the step of deriving a second memory address from the compressed printing activity data sequence, the second memory address representing a memory location in a second memory associated with the selected print element containing stored energization schedule data representing the energization schedule.

8. The method of claim 7, further comprising the steps of:

deriving a third memory address from the compressed printing activity data, the third memory address representing a third memory location in a third memory containing data representing a portion of the second memory address, the third memory address representing only printing prior to the present activation time interval; and retrieving the data representing the portion of the second memory address from the second memory location identified by the third memory address.

9. The method of claim 8 wherein the step of determining the energization schedule comprises retrieving the stored energization schedule data from the second memory location represented by the second memory address.

10. A method of producing a desired response in a first print element during a present activation time interval in a thermal printhead having an array of print elements, comprising:

establishing a desired print state for the first element during the present activation time interval;

determining printing schedules of the first print element and a second print element in the array;

generating printing activity data representative of the printing schedules of the first and second print elements corresponding to the present activation time interval and at least one other activation time interval;

compressing the printing activity data;

storing the compressed printing activity data in a first memory at a memory location associated with the first print element;

determining an energization schedule for the present activation time interval in response to the stored compressed printing activity data and the desired print state;

producing an energization signal representative of the energization schedule; and applying the energization signal to the first print element.

11. The method of claim 10, further comprising the step of deriving a second memory address from the compressed printing activity data, the second memory address representing a location in a second memory associated with the first print element containing stored energization schedule data, the stored energization schedule data representing a predetermined energization schedule.

12. The method of claim 11 wherein the step of determining an energization schedule comprises retrieving the stored energization schedule data from the memory location in the second memory represented by the second memory address.

13. The method of claim 12, further comprising grouping a plurality of distinct compressed printing activity data sequences such that the memory address derived from each one of the plurality of distinct printing activity data sequences is identical.

14. The method of claim 13, the step of determining the printing schedules includes determining the printing schedules with printing activity data corresponding to at least one activation time interval following the present activation time interval.

15. The method of claim 14, further comprising the step of deriving a second memory address from the compressed data, the second memory address representing a memory location in a second memory containing energization schedule data representing the energization schedule.

16. The method of claim 15 wherein the step of deriving the second memory address comprises the steps of:

deriving from the compressed printing activity data, a third memory address representing a location in a third memory containing data representing a portion of the second memory address, the third memory address representing only printing schedule intervals prior to the present interval;

retrieving the data representing the portion of the second memory address; and combining the retrieved portion of the second memory address and a portion of the compressed printing activity data to form the second memory address.

17. The method of claim 16 wherein the step of compressing the printing activity data comprises applying a run length compression technique to the printing activity data to produce the compressed printing activity data.

18. A method of producing a desired response in a selected print element during a present activation time interval in a thermal printhead having a two-dimensional array of print elements, comprising:

establishing a desired print state for the selected print element during the present activation time interval;

determining print states for a plurality of print elements in the array during the present activation time interval;

generating printing activity data representative of the print states of the selected print element corresponding to the present activation time interval;

compressing the printing activity data;

storing the compressed printing activity data in a first memory at a first memory location associated with the selected print element;

determining an energization schedule for the present activation time interval in response to the stored compressed printing activity data and the desired print state of the selected print element;

producing an energization signal representative of the energization schedule; and applying the energization signal to the selected print element.

19. The method of claim 18, further comprising the step of deriving a second memory address from the compressed printing activity data, the second memory address representing a second memory location in a second memory associated with the selected print element and containing energization schedule data, the energization schedule data representing the energization schedule.

20. The method of claim 19 wherein the step of determining an energization schedule comprises retrieving the energization schedule data from the second memory location represented by the second memory address.

21. The method of claim 20, further comprising grouping a plurality of distinct compressed printing activity data sequences such that the memory address derived from each one of the plurality of distinct printing activity data sequences is identical.

22. The method of claim 18 wherein the printing activity data determined for the plurality of elements in the array include the print state of at least one element not directly longitudinal or transverse to the selected print element during the present activation time interval.

23. The method of claim 22, further comprising the step of deriving a second memory address from the compressed printing activity data, the second memory address representing a location in a second memory associated with the selected print element and containing energization schedule data, the energization schedule data representing the energization schedule.

24. The method of claim 23 wherein the step of deriving the second memory address comprises the steps of:

deriving from the compressed printing activity data a third memory address representing a location in a third memory containing data representing a portion of the third memory address, the third memory address representing only print states of print elements longitudinally aligned with the first element during the present interval;

retrieving from the third memory address the data representing the portion of the first memory address; and combining the retrieved portion of the first memory address and a portion of the compressed printing activity data to form the second memory address.

25. The method of claim 23 wherein the step of deriving the second memory address comprises the steps of:

deriving from the compressed printing activity data a third memory address representing a location in a third memory containing data representing a portion of the third memory address, the third memory address representing only print states of print elements transversely aligned with the first element during the present interval;

retrieving from the third memory address the data representing the portion of the first memory address; and combining the retrieved portion of the first memory address and a portion of the compressed printing activity data to form the second memory address.

26. A method of energizing a first print element in a thermal printhead having an array of print elements, comprising:

selecting print elements in the array;

determining a possible printing schedule for each of the selected elements;

establishing for each possible desired print state of the first element a table containing each of the possible printing schedules for selected print elements in the array;

deriving a printing data sequence;

generating energization schedule data representing a desired energization schedule of the first print element for each possible combination of the possible printing schedules of the selected print elements;

compressing the energization schedule data;

storing the compressed energization schedule data in locations in a memory associated with the array;

determining an actual printing schedule of the selected print elements;

determining an actual desired state of the first print element during a present activation time interval;

retrieving the compressed energization schedule data in response to the actual printing schedule of the selected print elements and the actual desired print state of the first element;

determining an energization signal in response to the retrieved compressed energization schedule data;

producing the energization signal; and applying the energization signal to the first print element.

27. The method of claim 26 wherein the step of compressing the energization schedule data comprises applying a run length compression technique to the energization schedule data to produce the compressed energization schedule data.

28. The method of claim 26 wherein the step of retrieving the energization schedule data comprises the steps of:

determining a printing schedule of the first print element and at least one of the selected print elements adjacent to the first print element;

generating printing activity data representative of the printing schedule of the first print element and at least one of the selected print elements adjacent to the first print element;

compressing the printing activity data;

deriving a memory address from the compressed printing activity data; and retrieving stored data from the derived address in the memory associated with the array, said retrieved data being the energization schedule data.

29. The method of claim 28 wherein the step of compressing the energization schedule data comprises applying a run length compression technique to the energization schedule data to produce the compressed energization schedule data.

30. The method of claim 28 wherein the step of compressing the print activity data comprises applying a run length compression technique to the printing activity data to produce the compressed printing activity data.

31. The method of claim 30 wherein the step of compressing the energization schedule data comprises applying a run length compression technique to the energization schedule data to produce the compressed energization schedule data.

32. The method of claim 28 wherein the step of deriving the memory address comprises the steps of grouping the compressed printing activity data into subgroups; and deriving a portion of the memory address from a combination of the subgroups.

* * * * *